United States Patent [19]

Bascom et al.

[11] 4,069,657

[45] Jan. 24, 1978

[54] YARN TEXTURING PROCESS

[75] Inventors: Laurence N. Bascom, Signal Mountain, Tenn.; Franklin G. Parker, Glen Mills, Pa.; James W. Rogers, Wilmington, Del.

[73] Assignee: E. I. Du Pont de Nemours and Company, Wilmington, Del.

[21] Appl. No.: 597,139

[22] Filed: July 18, 1975

[51] Int. Cl.[2] ..... D02G 3/12

[52] U.S. Cl. ..... 57/160; 28/271; 264/103; 264/210 F

[58] Field of Search ..... 264/103, 210 F; 57/140 BY, 160, 157 F; 28/72.12

[56] References Cited

U.S. PATENT DOCUMENTS

| | | | |
|---|---|---|---|
| 2,957,747 | 10/1960 | Bowling | 264/176 F |
| 3,447,302 | 6/1969 | Field | 57/157 |
| 3,462,813 | 8/1969 | Dyer | 28/72 |
| 3,689,623 | 9/1972 | Kobayashi et al. | 264/210 F |
| 3,895,090 | 7/1975 | Kobayashi et al. | 264/210 F |

FOREIGN PATENT DOCUMENTS

| | | | |
|---|---|---|---|
| 47-38024 | 9/1972 | Japan | 57/140 BY |
| 1,158,601 | 7/1969 | United Kingdom | 264/103 |

*Primary Examiner*—Jay H. Woo

[57] ABSTRACT

Air-jet textured core/effect nylon yarn provides fabrics having better cover when the core component has been draw-oriented after conventional melt-spinning, and the effect component has been spin-oriented by melt-spinning at unusually high speed. The improved yarn is particularly useful in upholstery fabrics.

1 Claim, 2 Drawing Figures

YARN TEXTURING PROCESS

BACKGROUND OF THE INVENTION

This invention relates to air-jet textured core/effect textured yarns, and is more particularly concerned with production of improved nylon textured yarns.

Core/effect yarns have been prepared by feeding core yarns to an air-jet texturing device at substantially the take-off speed from the jet and feeding effect yarns at higher speeds to form bulky yarn products characterized by elongated loops extending outwardly from the core. Textured yarns can be prepared in this way from a variety of synthetic continuous filament yarns. The properties will depend upon the types of yarns used. Yarns which provide a relatively high cover per unit weight of fabric are desirable for textile fabrics, but the fabrics may be deficient in other respects. Abrasion resistance and the ability to be dyed readily with attractive dyes or to be printed easily are also important for such uses as upholstery fabric.

Nylon core/effect yarns provide fabrics which have good abrasion resistance and desirable dyestuff versatility, but which have had a relatively low cover per unit weight. Cover refers to the ability to hide a background. It can be measured by a "standard light transmission" test of fabric defined subsequently. The cover provided by nylon core/effect yarns is improved by the present invention.

SUMMARY OF THE INVENTION

In the process of the invention nylon core/effect yarn is prepared by an air-jet texturing process wherein multifilament core yarn is fed to the jet at a speed that is 1 to 10 percent greater than the take-off speed from the jet, and multifilament effect yarn is fed to the jet at a speed that is 20 to 300 percent greater than the take-off speed. The improvement of the present invention comprises feeding core yarn prepared by a process which includes cold-drawing the yarn at least 2.5× (drawing to at least 2.5 times the as-spun length), and feeding effect yarn prepared by a process in which the yarn is melt spun at a speed greater than 2000 yards per minute (1830 meters/minute) and is not cold-drawn.

Preferably the effect yarn is prepared by a process in which polyhexamethyleneadipamide is melt spun at a speed of at least 2700 yards per minute (2470 m./min.) and has a break elongation of 70 to 100 percent. The core yarn is preferably prepared by a process in which polyhexamethyleneadipamide is melt spun at a speed of less than 1000 yards per minute (915 m./min.) and is cold-drawn to have a break elongation of 20 to 40 percent.

The nylon core/effect yarns provide good cover in fabrics when produced within the range of effect yarn overfeeds indicated above. The examples show a marked improvement in cover when the spin-oriented effect yarn fed at 1.2 times or 3.1 times the feed speed of the core yarn, in comparison with yarns obtained when using effect yarns which have been melt-spun at 465 yards per minute (425 m./min.) and cold-drawn 4.2×. The core yarn is preferably fed to the jet at a speed that is 5 to 8 percent greater than the take-off speed from the jet. The overfeed allows the filaments to open up in the jet so that the effect yarn filaments can become securely entangled with the core yarn filaments.

DETAILED DESCRIPTION OF THE INVENTION

The effect yarn is a yarn of nylon which is extruded from a spinneret and wound up at such high speed that its molecules are oriented. The spin-oriented yarn is characterized by a break elongation of 50 to 115 percent (preferably 70 to 100%), a tenacity of at least 2 grams per denier, and a boil-off shrinkage of 2 to 6 percent. The yarns can be prepared by melt-spinning filaments of polyhexamethyleneadipamide at greater than 2000 yards per minute (1830 meters/minute), preferably about 3000 yards per minute (2743 m./min.), cooling the filaments to a non-tacky state, immediately steaming them, and winding them up.

Figure 1:
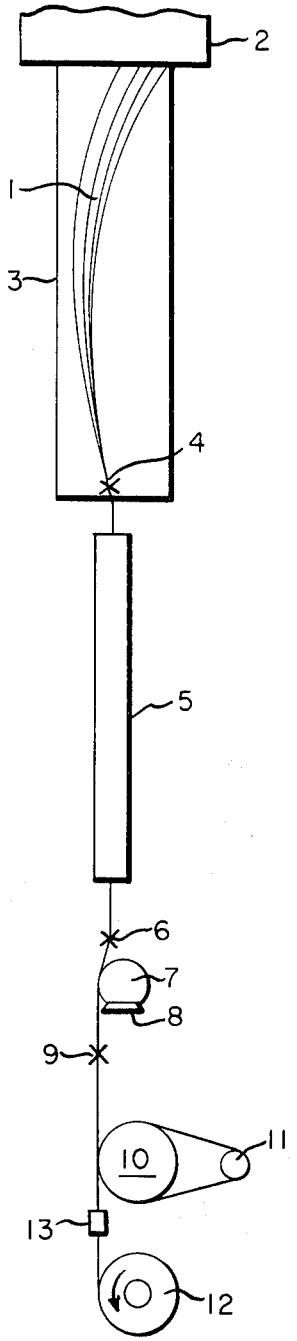
FIG. 1 is a schematic representation of a preferred process for producing spin-oriented yarns for use as effect yarns in accordance with the invention.

FIG. 1 is a diagrammatic representation of a preferred process for making the spin-oriented yarn used in this invention. Referring to that figure, filaments 1 are extruded from spinneret assembly 2 into quench chimney 3 and are cross-flow quenched by room temperature air flowing from right to left. After cooling to a non-tacky state, the filaments are converged into a yarn by guide 4 and pass through steam conditioner 5, through guide 6, over finish roller 7, immersed in finish bath 8, through guide 9, then wrap around high-speed puller roll 10 and associated roll 11 and are wound up as package 12. An interlace jet 13 as disclosed in Bunting et al. U.S. Pat. No. 2,985,995 may be used.

Because the filaments are extruded at unusually high speeds, the length of the quench chimney should be longer than usual; a 60-inch (152.4 cm.) length has been found to be satisfactory when spinning at 3000 yards per minute (2743 m./min.). In general, the yarn temperature should be less than about 65° C. before it contacts the first guide.

Steaming is important to develop the desired feed yarn properties. A 50-inch (127 cm.) steam tube equipped with steam orifices at the top can be used for suitable steam pressures to insure good denier uniformity, spinning performance and package acceptability.

Figure 2:
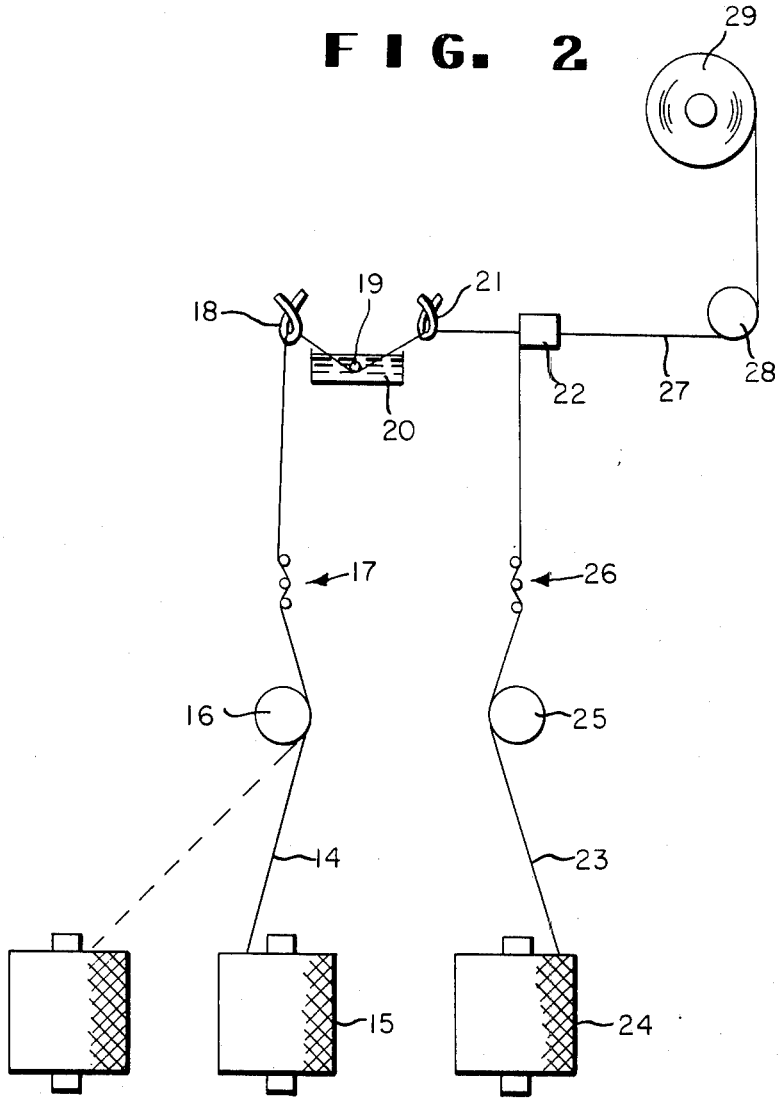
FIG. 2 illustrates a suitable texturing process for use in accordance with the invention.

FIG. 2 illustrates a suitable process for preparing core/effect textured yarns. Spin-oriented effect yarn 14 from package 15 is led three times around feed roller 16, passes through tensioner 17, around guide 18, under pin 19 which is immersed in bath 20 of room-temperature water, then passes around guide 21 and through air-jet bulking device 22. Core yarn 23 led from package 24 takes three wraps around roller 25, passes through tensioner 26 and goes through air-jet texturing device 22. The textured core/effect yarn 27 then passes around roller 28 and is taken up on package 29. As indicated by the dotted line, more than one effect yarn can be led to the jet. In the process, the effect and core yarns are overfed to the jet, the effect yarn overfeed being greater than that of the core yarn.

The air-jet bulking apparatus produces crunodal surface loops in the yarn. Preferred jets are disclosed in Lubach, U.S. Pat. No. 3,545,057 and Becher, U.S. Pat. No. 3,097,412. To improve the efficiency of the jet, the effect yarn is preferably immersed in a water bath, as illustrated, although this is not an essential aspect of the present invention.

The new yarns have suprisingly good cover per unit weight, which makes them suitable for upholstery fabrics. This combined with other advantages of nylon yarn, including coloration with acid dyes, abrasion resistance, soft hand and lightfastness makes them particularly desirable for such uses.

The yarn may contain minor amounts of the usual delusterants, particulate matter, antistats, optical brighteners, antioxidants and copolyamide components provided it meets the requirements that are set forth herein. Suitable finishes may be used in preparing the new yarns.

EXAMPLE 1

A. Polyhexamethyleneadipamide flake of 37.7 relative viscosity ($RV_{66}$) and containing about 0.02% $TiO_2$ is melted at 287° C. in a steam-blanketed grid melter. The melt passes at 115 gms./min. through a standard pack and through 68 Y-shaped spinneret capillaries each arm of the "Y" being at a 120° angle from the other and being described by a rectangle 3 mils (76.2 microns) wide by 15 mils (381 microns) long and each having a circular end 5 mils (127 microns) in diameter. Each capillary is 5 mils deep. The extruded filaments pass through a 58 inch (147 cm.) chamber where they are cross-flow quenched with room-temperature air. They then contact a cross-pin guide which converges them to form a yarn. A lubricating finish is applied as the yarn passes across a rotating roll in a finish bath. The yarn then passes through another cross-pin convergence guide and then through a 51-inch long (130 cm.) steam conditioner tube into which 12 psig. (0.816 atmosphere) steam is introduced from two 0.060 inch (0.152 cm.) orifices. The yarn wraps twice around a set of puller rolls rotating at a surface speed of 3000 yd./min. (2743 m./min.) and is packaged at about 0.1 gram/denier tension. Just before the windup the yarn is interlaced as shown in Bunting & Nelson, U.S. Pat. No. 2,985,995 to a pin drop count of 3.5 cm. The yarn contains about 1.5% finish and the filaments are trilobal in cross-section having a "modification ratio" as measured in Holland, U.S. Pat. No. 2,939,201 of about 1.7. The yarn $RV_{66}$ is 46.6 and the yarn has a denier of 400, a tenacity of 2.35 grams/denier, an elongation of 75%, and a boil-off shrinkage of 3.2%. This spin-oriented yarn is identified as "Yarn A".

B. Polyhexamethyleneadipamide flake of 36 $RV_{66}$ and containing about 0.02% $TiO_2$ is melted at about 290° C. in a steam-blanketed grid-melter and melt spun essentially as shown in FIG. 1 except that the steam conditioner tube is 6 feet (1.83 meters) long and the windup speed is 465 yards/minute (425 m./min.) instead of 3000 yards/minute (274 m./min.). The as-spun yarn is 1580 denier. The spinneret is essentially the same as for "Yarn A". The yarn is doffed and cold-drawn 4.2× on a Whitin RG-4 draw twister, available from Whitin Machine Works, Whitinsville, Massachusetts U.S.A., using the following conditions: draw roll speed: 199 yards/minute (182 m./min.); draw pin diameter: ⅜ inch; number of yarn wraps around draw pin: 2½; number of yarn wraps around the draw roll and associated separator roll: 6; spindle speed: 5430 revolutions/minute producing 0.76 turns/inch (30 turns/meter) twist in the yarn. This "Yarn B" has an $RV_{66}$ of 40, a denier of 400, a tenacity of about 5.4 grams/denier, an elongation of 34%, and a boil-off shrinkage of 10.5%.

Three textured yarns are made, each essentially as shown in FIG. 2. For each, a single core yarn is fed into the texturing jet (jet described in Lubach U.S. Pat. No. 3,545,057) at 8% overfeed and 3 effect yarns are fed into the jet at 25% overfeed. Yarn take-off speed from the jet is the standard 100 yarns/minute (91.4 m./min.). The textured yarns have the following compositions: Yarn I (Control): core and effect yarns are both "Yarn A". Yarn II (Control): core and effect yarns are both "Yarn B". Yarn III (Invention): core yarn is "Yarn B", effect yarn is "Yarn A".

Each yarn is woven into a filling faced, 16 picks per inch (6.3 ends/cm.) × 112 ends/inch (44.1 ends/cm.), crowsfoot satin fabric, using for the wrap standard 70-denier/34-filament 6,6 nylon yarn having an elongation of about 31% and a tenacity of about 5.0 gms./den.

The fabrics are open-width scoured, beck dyed and dried at 250° F. wet width with a 3% overfeed. Evaluations of the resulting fabrics are given in the table.

The improved cover of the fabric containing Yarn III can be seen with the naked eye. It is also reflected in the low value of "Standard Light Transmission". It is interesting that the cover of the fabric containing Yarn I is similar to that of the fabric containing Yarn II even though the former is lighter in weight.

Each fabric is also treated for resistance to abrasion and, surprisingly, they are found to be essentially equivalent.

EXAMPLE 2

"Yarn A" and "Yarn B" of Example 1 are used to prepare Yarns II and III as in Example 1 except that the overfeed of the effect yarns is 225% (instead of 25%) and the overfeed of the core yarn is 6% (instead of 8%). Fabrics made with Yarn III have a higher cover than those made with Yarn II.

Fabrics made with the new yarns (Yarn III) are superior to those made with the "Yarn II" yarns which represent prior art. They also have superior dyeing versatility, as compared to those made with polypropylene yarns, and thus represent a significant advance in textile technology.

TABLE

| Identification of Fill Yarn in Fabric | Weight in oz./yd.$^2$ (gm./meter$^2$) | Thickness in mils (cm.) | Width in inches (cm.) | Standard Light Transmission (%) |
|---|---|---|---|---|
| I | 6.37 (216) | 25.5 (0.065) | 39½ (100.3) | 0.8 |
| II | 6.99 (237) | 27.5 (0.070) | 37¾ (95.9) | 0.7 |
| III | 6.94 (235) | 29.5 (0.075) | 38 (96.5) | 0.4 |

Test Methods

Relative viscosity ($RV_{66}$) of polyhexamethyleneadipamide (66-nylon) is defined as the ratio at 25° C. of the absolute viscosity in centipoise of an 8.4% by weight solution of 66-nylon in 90% formic acid to the absolute viscosity in centipoise of the formic acid solvent. Reported values were determined by ASTM method D789-53T and the result multiplied by the constant 1.0183.

"Break elongation" and "tenacity" are determined on a table model instron generally according to ASTM method D2256-66T. All samples are conditioned on the package for 24 hours at 74° F. (23.3° C.) and 72% relative humidity (RH) and measured in the same environment. The properties for yarns are measured with these machine and sample conditions:

Five inch (12.7 cm.) per minute extension rate.

Five inch (12.7 cm.) gauge length.

Pneumatic rubber coated Instron clamps.

Three turns per inch of twist added to sample.

"Boil-off shrinkage" is the change in length as a percentage of original length of a skein of yarn upon immersion in boiling water. Reported values were measured according to the following procedure:

Skeins of yarn are prepared on a standard denier reel of 1⅛ meters circumference. The number of revolutions on the denier reel is determined as follows:

7–29 denier — 800 revolutions.

30–50 — 400 revolutions.

51 denier and above — 200 revolutions. The skeins are then straightened by hanging one end of the skein on one-half inch (1.27 cm.) diameter horizontal rod and attaching a 4.68 pound (2.12 kg.) weight on the other end of the skein. The weight is then raised vertically 6 inches (15.2 cm.) and allowed to fall freely. Raising and dropping of the weight is repeated until a constant skein length ($L_1$) is obtained. The skeins are then wrapped in cheesecloth, 8 skeins to a bundle, and placed in a boil-off pot at 100° C. for 70 minutes. This is followed by a 5-minute spin cycle in a commercial washing machine. The skeins are lagged at 74° F. (23.3° C.) and 72% RH for 24 hours. The skein length, after boil-off, $L_2$ is measured by using the same procedure as for $L_1$. "Boil-off" shrinkage is then calculated according to the formula, $$\% \text{ Boil-off shrinkage} = \frac{L_1 - L_2}{L_1} \times 100.$$

"Standard Light Transmission" is a measure of fabric covering power. It is measured in a manner similar to ASTM, Part 26, Method D-1494.

In general, diffuse white light is projected onto the specimen. The amount of light transmitted by the specimen is measured by a photometer.

Suitable apparatus:

a. Durst No. 609 projector; Durst S. A., Bolzano, Italy b. Photomultiplier microphotometer, Catalogue No. 10–211; American Instrument Co., Inc., Silver Spring, Md. 20900 c. Constant Voltage Transformer, Solovolt, 0.261 amp, 115 volt AC; Sola Electric Co., Chicago, Ill. 60650. The constant voltage transformer is connected to the projector.

Specimens should be free of wrinkles and creases and they should be conditioned at 70° ± 2° F. (21.1° ± 1.1° C.) and 65 ± 2% relative humidity for a minimum of 16 hours. Results are recorded in percent (0% for no light condition, 100% for full scale reading with no fabric present).

The distance between points of interlace along a threadline is measured on an automatic pin-drop tester similar to the one shown in Hitt, U.S. Pat. No. 3,290,932. Yarn from the sample is first stripped for 30 seconds into a sucker gun. The threadline is then passed over a tension wheel (one loop), then over three guide pins and an alignment pin to a 1¼ inch (3.18 cm.) diameter drive roll and separator roll, and finally exhausted into a sucker gun. Five wraps are taken around the drive and separator rolls. Between the drive roll and the alignment pin an injector needle is inserted into the yarn bundle between filaments. The drive roll moves the yarn at a speed of 250 cm./minute. At points of interlace the yarn snags on the needle and tension builds up. The machine is set to stop when tension reaches 8 grams and then resets automatically. Distance the yarn travels between points of interlace is measured electronically. Ten readings per sample are measured and averaged and recorded as "pin drop count".

I claim:

1. In the preparation of nylon core/effect yarn by an air-jet texturing process wherein multifilament core yarn is fed to the jet at a speed that is 5 to 8 percent greater than the take-off speed from the jet, and multifilament effect yarn is fed to the jet at a speed that is about 25 percent greater than the take-off speed from the jet; the improvement which comprises feeding core yarn prepared by a process in which polyhexamethyleneadipamide is melt spun at a speed of less than 1000 yards per minute and which includes cold-drawing at least 2.5× to a break elongation of 20 to 40 percent, and feeding effect yarn prepared by a process in which polyhexamethyleneadipamide is melt spun at a speed greater than 2000 yards per minute and is not cold-drawn and the yarn has a break elongation of 70 to 100 percent.

* * * * *